US007878951B2

(12) United States Patent
Roman et al.

(10) Patent No.: US 7,878,951 B2
(45) Date of Patent: Feb. 1, 2011

(54) GYMNASTIC MACHINE

(75) Inventors: Maurizio Roman, Noale (IT); Leo Zaccherini, Riolo Terme (IT)

(73) Assignee: Technogym S.p.A., Gambettola (FC) (IT)

( * ) Notice: Subject to any disclaimer, the term of this patent is extended or adjusted under 35 U.S.C. 154(b) by 798 days.

(21) Appl. No.: 11/708,154

(22) Filed: Feb. 16, 2007

(65) Prior Publication Data

US 2007/0202995 A1 Aug. 30, 2007

(30) Foreign Application Priority Data

Feb. 24, 2006 (IT) ..... RA2006A0012

(51) Int. Cl.
*A63B 69/06* (2006.01)
*A63B 21/068* (2006.01)

(52) U.S. Cl. ..... 482/72; 482/95

(58) Field of Classification Search ..... 482/70–73, 482/51, 95–96, 907

See application file for complete search history.

(56) References Cited

U.S. PATENT DOCUMENTS 4,046,373 A * 9/1977 Kim ..... 482/42
4,826,158 A * 5/1989 Fields, Jr. ..... 482/142
5,263,919 A * 11/1993 Hollenback ..... 482/145
7,294,100 B2 * 11/2007 Bull ..... 482/51

FOREIGN PATENT DOCUMENTS

CN 2179172 Y 10/1994

OTHER PUBLICATIONS

Office Action issued Sep. 25, 2009 from the Chinese Patent Office.

* cited by examiner

*Primary Examiner*—Fenn C Mathew
(74) *Attorney, Agent, or Firm*—Abelman, Frayne & Schwab

(57) ABSTRACT

Gymnastic machine (1) includes a frame (10), a slide (20) carried movable by the frame (10) along a given direction (D) from and to a starting station (30), with the slide (20) being suitable for coupling with a first limb in such a way as to guide it along the given direction (D) and to enable, in use, to control a scissor movement of the first limb with respect to a second limb retained at the starting station (30).

31 Claims, 4 Drawing Sheets

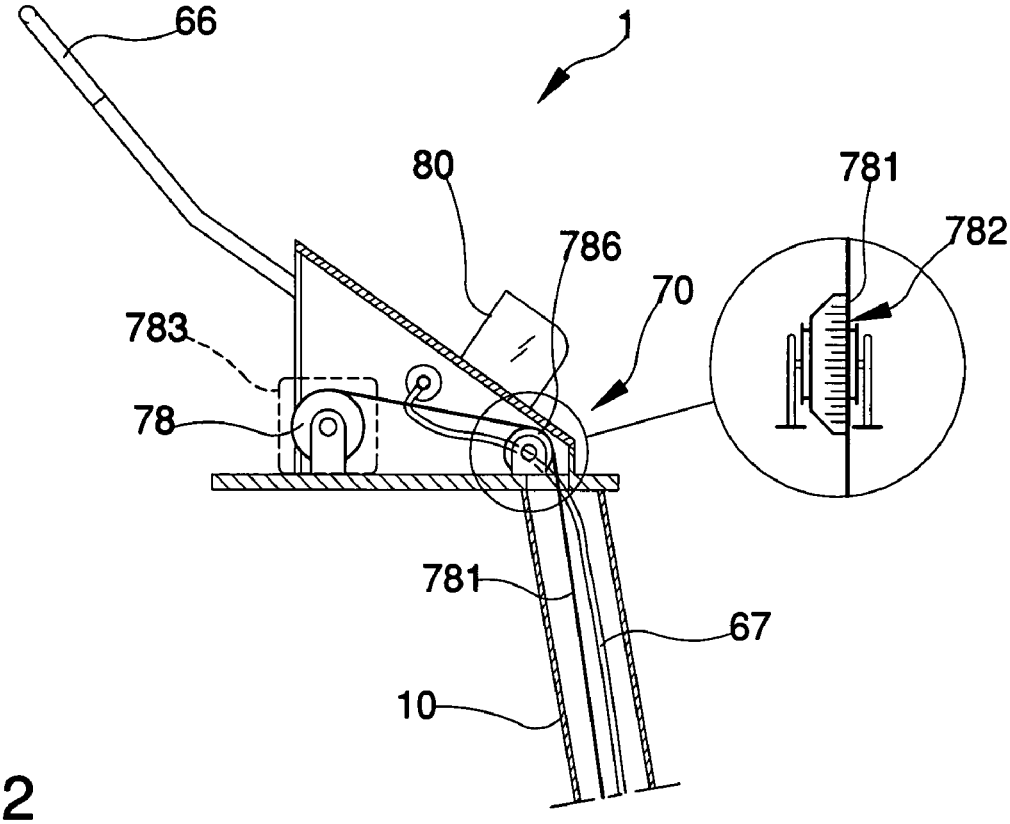
Fig. 2
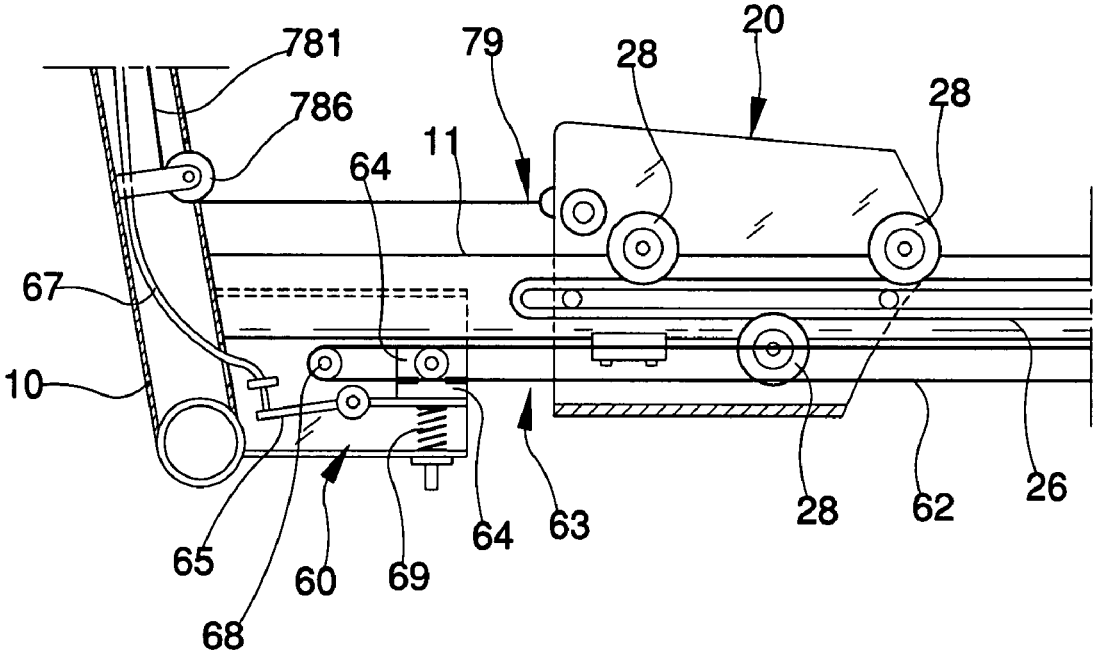

GYMNASTIC MACHINE

BACKGROUND OF THE INVENTION

1. Field of the Invention

The present invention relates to a gymnastic machine. In particular, the present invention relates to a gymnastic machine provided with a support movable along a given direction from and to a starting station in order to perform muscle stretching exercises. In more detail, the present invention relates to a gymnastic machine for muscle stretching provided with a support movable along a given direction from and to a starting station in order to perform alternating movements. The present invention also relates to a method of using the gymnastic machine for muscle stretching.

2. Description of the Prior Art

It is well known that in the field of gymnastic machines for muscular activities of various kinds, the machines dedicated to muscle stretching are a narrow minority. This fact is mainly justified by the critical nature of stretching exercises, which are only apparently simple, but in fact are particularly insidious if executed by an inexperienced athlete without a supervising trainer, given the high quantity of degrees of freedom left to the athlete while executing such exercises. Therefore, the market for said machines is very limited, because the presence of a trainer could place every athlete, even if inexperienced, in the condition of executing effective stretching exercises also free style, or through the simple availability of a wall or of a tree, if outdoors, or of a wall bar, if in a gym. On the other hand, relying on a trainer requires being tied down to a schedule that does not always suit the athlete's needs, and bearing the related costs, which increase in proportion to the number of training sessions. This is likely to be particularly costly for those who suffer from backache.

To overcome the above-mentioned drawbacks, the applicant has recently filed the invention Patent Application No. RA2006A000009 wherein teachings are provided to construct preferably but without limitation a gymnastic machine usable for performing stretching exercises for the posterior kinetic chain, and particularly for the glutei, the piriformis muscle, the rachis, the ischiocrural muscle and the femoral bicipital muscle, and therefore for the lumbar musculature too, in order to prevent backache. According to a preferred embodiment of said machine, the user may employ a slide movable along a longitudinal guide to control the rotating movement of a support with respect to the slide. With the back and the glutei bearing on the slide and the lower limbs on the support, the relative movement of the support induces the lower limbs to rotate with respect to the back and thus produces a stretching of the lumbar muscles.

Though it is particularly safe and very easy-to-use, such gymnastic machine does not allow to stretch the ileopsoas muscle, or hip flexor muscle, and consequently to prevent the compression of the lumbar vertebrae due to contraction of the muscles in the anterior kinetic chain. As a result, people wishing to train/stretch said kinematic chain currently cannot use a gymnastic machine and must necessarily resort to the aid of a trainer, with the above-mentioned drawbacks this entails.

SUMMARY OF THE INVENTION

An object of the present invention is a gymnastic machine for muscle stretching that allows the disadvantages described above to be solved, and which is suitable to satisfy a plurality of requirements that to date have still not been addressed, and therefore, suitable to represent a new and original source of economic interest and capable of modifying the current market of gymnastic machines for muscle stretching.

This and other objects of the present invention, which will become apparent hereinafter, are achieved by providing a gymnastic machine for muscle stretching that includes a frame, a slide carried movable by the frame along a given direction from and to a starting station, and that is characterised in that the slide is suitable for coupling with a first limb in such a way as to guide it along the given direction and to enable, in use, to control a scissor movement of the first limb with respect to a second limb retained at the starting station; by providing a method for using a gymnastic machine for muscle stretching that is characterized by including the step of stably positioning a second limb in a starting station; the step of associating a first limb with a slide carried movable by a frame along a given direction from and to the starting station; the step of actuating the slide with respect to the starting station and the step of controlling, in use, a scissor movement of said first limb across said second limb; and by providing a method for training on a gymnastic machine for muscle stretching.

BRIEF DESCRIPTION OF THE DRAWINGS

Further characteristics and advantages of the gymnastic machine and of the method according to the present invention will be more apparent from the description below, set forth with reference to the accompanying drawings, which illustrate some non-limiting examples of embodiment, in which, for the sake of convenience, identical or corresponding parts of the machine are identified by the same reference numbers.

The drawings show:

FIG. 2 a side elevation view, on an enlarged scale, of FIG. 1, with some parts removed for the sake of clarity;

DETAILED DESCRIPTION OF THE PREFERRED EMBODIMENTS

Figure 1:
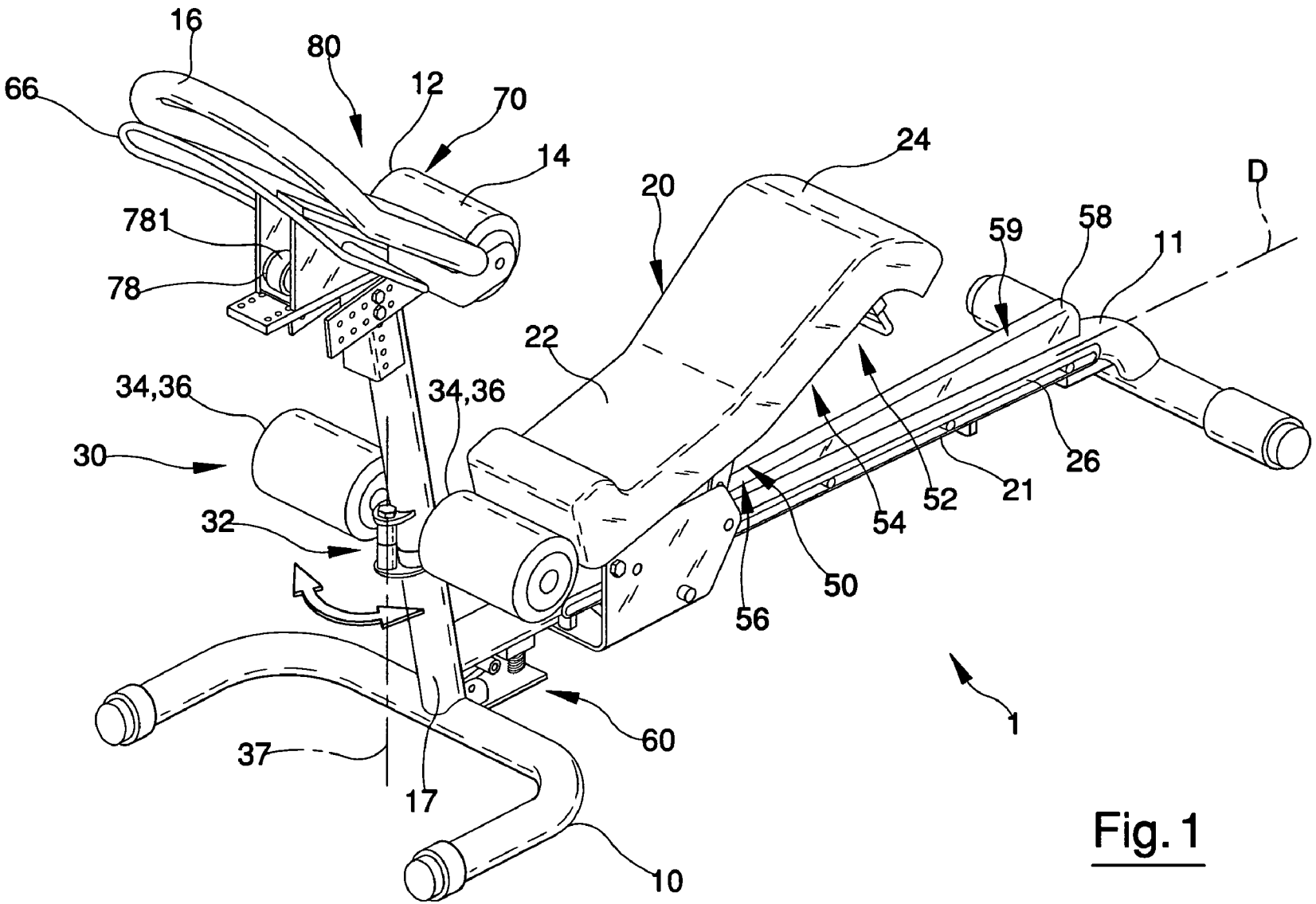
FIG. 1 a schematic perspective view of a first preferred embodiment of a gymnastic machine according to the present invention in a first operative position.

In FIG. 1, number 1 indicates, in its entirety, a gymnastic machine for the performance of muscle stretching exercises. This machine 1 comprises a frame 10 supporting a support member 20 by means of a guide 21 so constructed that the support member 20 is movable along a given direction D from and to a starting station 30. It must be noted that the following description is provided with reference to the lower limbs of a user. For the sake of completeness, it should be noted that the guide 21 is provided with two longitudinal members 26 supported by a central beam 11 on the frame 10, and that the support member 20 is carried by the members 26 in a freely longitudinally sliding manner by means of the interposition of a plurality of rollers 28 that hold bilaterally the support member 20 engaged on the guide 21. In view of the above description, the support member 20 can be interpreted as a slide that, for sake of simplicity, will be indicated, in the following, by the same number 20.

With reference to the attached drawings, the starting station 30 is designed to house a first lower limb, which may be either one of a pair of limbs, and the slide 20 is shaped to provide support for the second lower limb, so as to guide such second limb along the direction D and enable, in use, to control a scissor movement of the second limb in relation to the first limb, which is retained in the starting station 30. As shall be readily apparent hereafter, means are provided to prevent straining of the lower limb muscles and to make it safe to perform muscle stretching exercises.

Again with reference to FIG. 1, the station 30 comprises a unit 32 designed to house stably the first limb, and it is provided with a rest 12 carried rigidly by a central upright 17 forming part of the frame 10 and comprising a cushion 14 for the upper part of the user's body. If necessary, said rest 12 may comprise a handlebar 16, as shown in FIG. 1, wherein said handlebar is ring-shaped simply for reasons of practicality and safety.

With reference to FIG. 1, and with particular reference to FIGS. 3 and 4, the machine 1 comprises a controlling device, associated with the slide 20 and suitable for controlling, in use, the rotation of the limb carried by the slide 20 with respect to the given direction D during the performance of the scissor movement, as described in more detail later on.

It must be noted that the unit 32, designed to house stably the first limb, is shaped so as to induce and maintain the flexion of such limb In this regard, the unit 32 comprises a retaining member 34, which can be selectively disengaged, for holding a joint of the first limb. In particular, said retaining member 34 comprises a cushion 36 for the posterior part of the leg of the first limb. This cushion 36 is hinged to the frame 10 around a substantially vertical axis 37 so that it is switchable between a position of use, shown in FIG. 1, wherein it lies transverse to the direction D, and a neutral position, rotated through about 90° with respect to the first position. For the sake of clarity, when the cushion 36 occupies the respective position for use, it provides support for the user's first lower limb and enables the user to keep the limb flexed without effort, with the knee joint kept bent at an approximately 90° angle. On the other hand, when the cushion 36 occupies its respective neutral position, user wishing to perform the scissor movement must exert an adequate muscular effort to keep his/her first lower limbs within the starting station 30 without the aid of auxiliary means.

Figure 3:
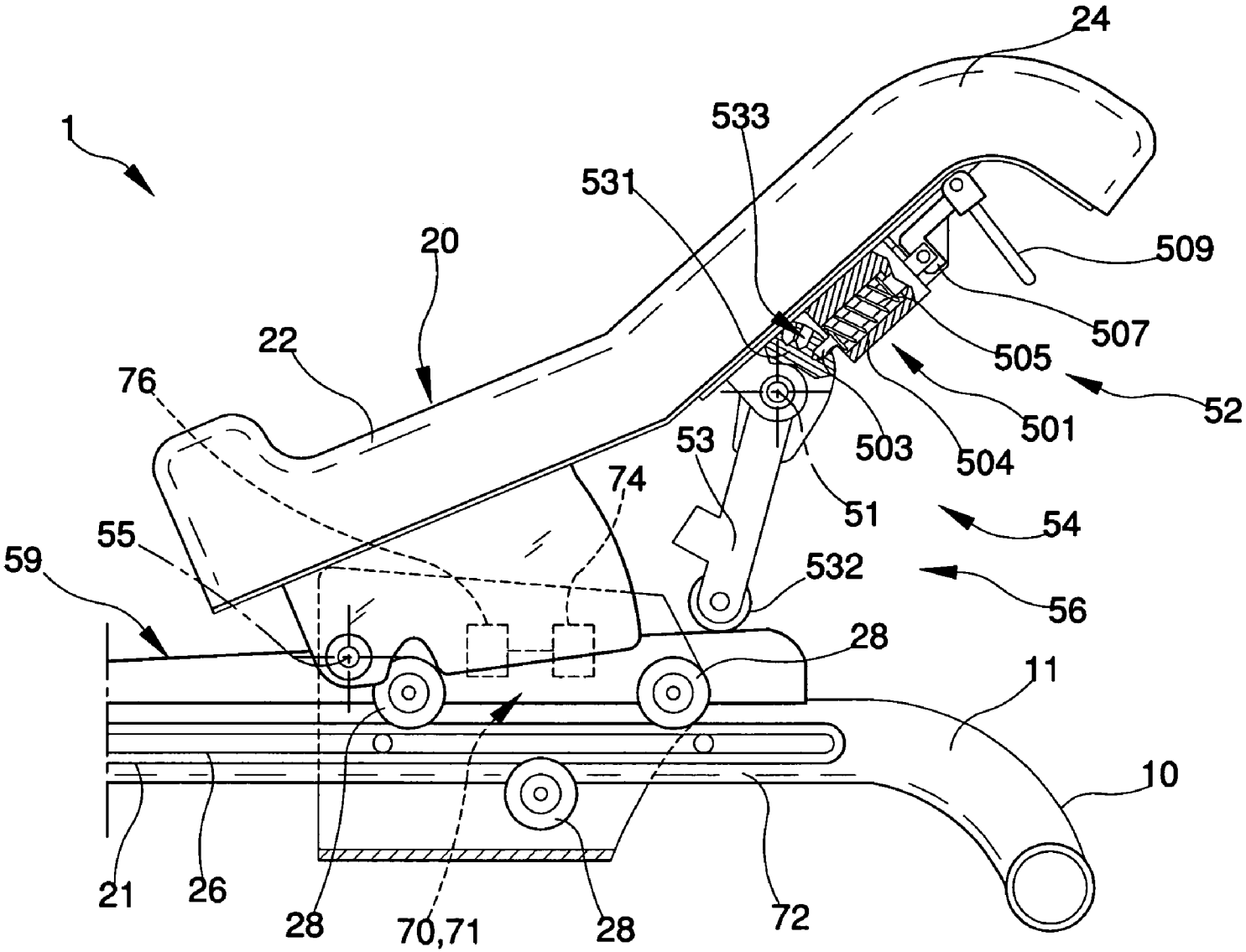
FIG. 3 is a side elevation view of a portion extracted from FIG. 1 on an enlarged scale and in a second operative position.

With particular reference to FIG. 3, the slide 20 comprises a base anterior portion 22 that is shaped in such a given way as to support at least a portion of the second lower limb placed between the knee and the foot. Furthermore, the slide 20 comprises a posterior portion 24 for resting the neck of the foot of said second limb. For the sake of convenience, here and on the following pages, said posterior portion 24 may be mentioned using the expression tibial cushion 24. Furthermore, said anterior portion 22 is associated with a regulating unit 50 suitable for varying the position of the portion with respect to the frame 10, and consequently for changing the angle of the leg of the second limb with respect to said frame 10. In particular, said regulating unit 50 comprises a first regulating device 52 for adjusting the starting position/the reference position of the portion 22/of the tibial cushion 24 with respect to the direction D/to the frame 10, and a second regulating device 54 suitable for changing, in use, the inclination of the portion 22/of the tibial cushion 24 with respect to the direction D/to the frame 10, and particularly around an axle 55 integral with the slide 20, in relation to the current distance between the slide 20 and the station 30.

The second regulating device 54 comprises a roller tappet 56 carried by the slide 20 and a shaped member 58 delimited by a profile 59 that is suitable for controlling the rotation of the portion 22/of the tibial cushion 24 with respect to the direction D/to the frame 10. The weight of the user performing the exercise ensures that a rolling contact is constantly maintained between the roller tappet 56 and the shaped member 58, without any need to include a spring return component to guarantee the proper operation of the second regulating device 54.

It must be noted that the profile 59 is shaped like a plane 59 decreasing towards the starting station 30. The rotation of the tibial cushion 24 thus increases in a substantially linear fashion. However, where it is deemed advisable, it may be advantageous to shape the profile 59 differently in order to impose different variations in the inclination of the portion 22/of the tibial cushion 24 with respect to the frame 10/to the direction D as the slide moves from and to the station 30.

Again with reference to FIG. 3, the first regulating device 52 comprises a support member 53 for the roller tappet 56 that is adjustable in at least two positions, to determine reference inclinations/starting inclinations of the portion 22/of the tibial cushion 24 with respect to the given direction D/to the frame 10. In particular, the member 53 comprises a lever 53 carried rotatable by the slide 20 with respect to an axle 51 parallel to the axle 55, and which can be locked in a given position by a locking device 501. In this regard, said locking device 501 comprises a pin 503 snap fitted prismatic to a support 504 by means of the thrust of a spring 505 contained inside a support member 504, which can be switched by a lever 509 connected to the pin 503 by means of a connecting member 507. Said pin 503 faces a head 531 that is carried by the lever 53 at opposite side with respect to the respective wheel 532, in such a way as to engage a radial hole 533 from a plurality of radial holes 533 provided in the head 531, each of which coincides with a starting inclination of the portion 22/of the tibial cushion 24 with respect to the direction D. In view of the above description, the regulating device 52 enables to define starting inclinations of the tibial cushion 24.

With particular reference to FIG. 2, the machine 1 comprises a braking device 60 suitable for controlling the position of the slide 20 with respect to the starting station 30 in order to prevent straining of the musculature of the lower limbs. The braking device 60 comprises an elongated member 62, which is rigidly connected to the slide 20 and carried parallel to the given direction D between a pair of jaws 64, at least one of which is movable transversally to the direction D against the force of a spring to switch the braking device 60 from a respective active position to a respective inactive position, which permits the operation of the slide 20 and its consequent displacement from and to the station 30. It must be noted that the elongated member 62 comprises a foil 62 wound in a ring around two transmission elements 68 carried by the frame 10 at the ends of the elongated members 26; it must be also noted that the foil 62 is connected to the slide 20 by means of the respective ends; and that the said foil 62 is provided with a braking branch 63 positioned between the jaws 64 in order to be alternately locked in place or left free to move with respect to the jaws 64.

In this regard, the device 60 comprises a manually-operated member 66 carried by the frame 10 for controlling the movement of at least one of the jaws 64 in relation to the other from and to a respective locking position, wherein the elongated member 62 is normally held locked by the pair of jaws 64 so as to prevent any movement of the slide 20 along the given direction D. This manually-operated member 66 comprises a lever 66 hinged to the frame 10 and interfaced with the lower jaw 64 by means of a lever 65, which can be actuated by means of a Bowden cable 67 connected to the lever 66. Clearly, the presence of a spring 69 acting on the lower jaw 64 allows to define the normal locked situation of the foil 62 and consequently also of the slide 20, and thus enables the second limb to perform scissor movement with respect to the first limb in safety because, when the lever 66 is released, the slide 20 is locked in its respective current position.

Again with reference to FIG. 2, the machine 1 comprises a measuring device 70 for measuring the position of the slide 20 with respect to the starting station 30; this device is suitable for providing information about the progress of the muscle stretching, able to give significant data on the effectiveness of the training session, or series of successive training sessions.

The measuring device 70 is analogical and comprises a tape measure 78 with a tape 781 presenting a graduated scale 782 and wound in a spiral inside a box 783. The tape 781 presents one end 785 connected to the slide 20 to enable a measurement of the latter's current position with respect to the starting station 30. In this regard, the tape 781 is wound around a pair of pulleys 786 supported by the frame 10 to define a given path between the rest 12 and the slide 20 so as to facilitate the user's reading of the graduated scale 782 during the training session. It must be noted that the tape 781 is associated with a spring return component, known and therefore not shown, inside the box 783, and that the tape 781 internally engages at least a portion of the upright 17, which serves as a safety casing. It must be noted that the employment of a tape measure on a machine for muscle training is in itself new and original, and enables a simple and cost-effective monitoring of the user's muscle stretching progress. As it is well known, muscle stretching exercises are all the more effective the longer the elongated position is maintained, and an indicator of the effectiveness of the training is represented by the time interval during which said position can be maintained. Therefore, the machine 1 has been provided with a timer device 80 of known type suitable for timing the duration of an exercise, or of the time interval during which the slide 20 is held in a given position with respect to the starting station 30 by means of the jaws 64.

From the above description, it is clear that, providing the braking device 60 has been disengaged, the slide 20 is free to move from and to the station 30. Therefore, actuating the slide 20 along the respective guide 21, and the consequent performance of the scissor movement is readily achievable simply by exploiting the gravity associated with the weight of the user performing the exercises, and particularly with the part of the user's weight coming to bear on the second lower limb, i.e. the limb that comes to bear on the slide 20.

In addition, the training method that can be implemented on a machine 1 as described above is easily understood from the above description and requires no further explanation.

It is worth noting, however, that such method comprises the steps of: positioning stably a first limb in the starting station 30 situated in front of the user performing the exercise, with his/her knee bent and the posterior portion of the first limb resting on the front portion of the cushion 36; resting the knee and the tibia of the second limb on the base portion 22 of the slide 20, and the neck of the foot on the tibial cushion 24; actuating the slide 20 with respect to said starting station 30; and controlling, in use, a scissor movement of said second limb by means of a braking device 60. It must be noted that the step of actuating the slide 20 with respect to the starting station 30 and the step of controlling, in use, the scissor movement of said second limb by means of the braking device 60 may take place simultaneously.

Finally, it is clear that modifications and variants can be made to the gymnastic machine 1 described and illustrated herein without however departing from the protective scope of the present invention.

For instance, as already explained with reference to the Italian Patent Application No. RA2006A000009 by the applicant, it may be advisable to control the movement of the slide 20 on the guide 21 by means of an actuating device, possibly operated on the basis of cycles programmed by a trainer to suit a given user's specific needs. This opportunity may be particularly useful in the case of users particularly out of condition, or with little experience of performing physical exercises on their own. For the sake of practicality and given the analogy, reference should be made to the corresponding part of the application '009, the teachings of which are considered an integral part of the present application for the sake of brevity.

Figure 4:
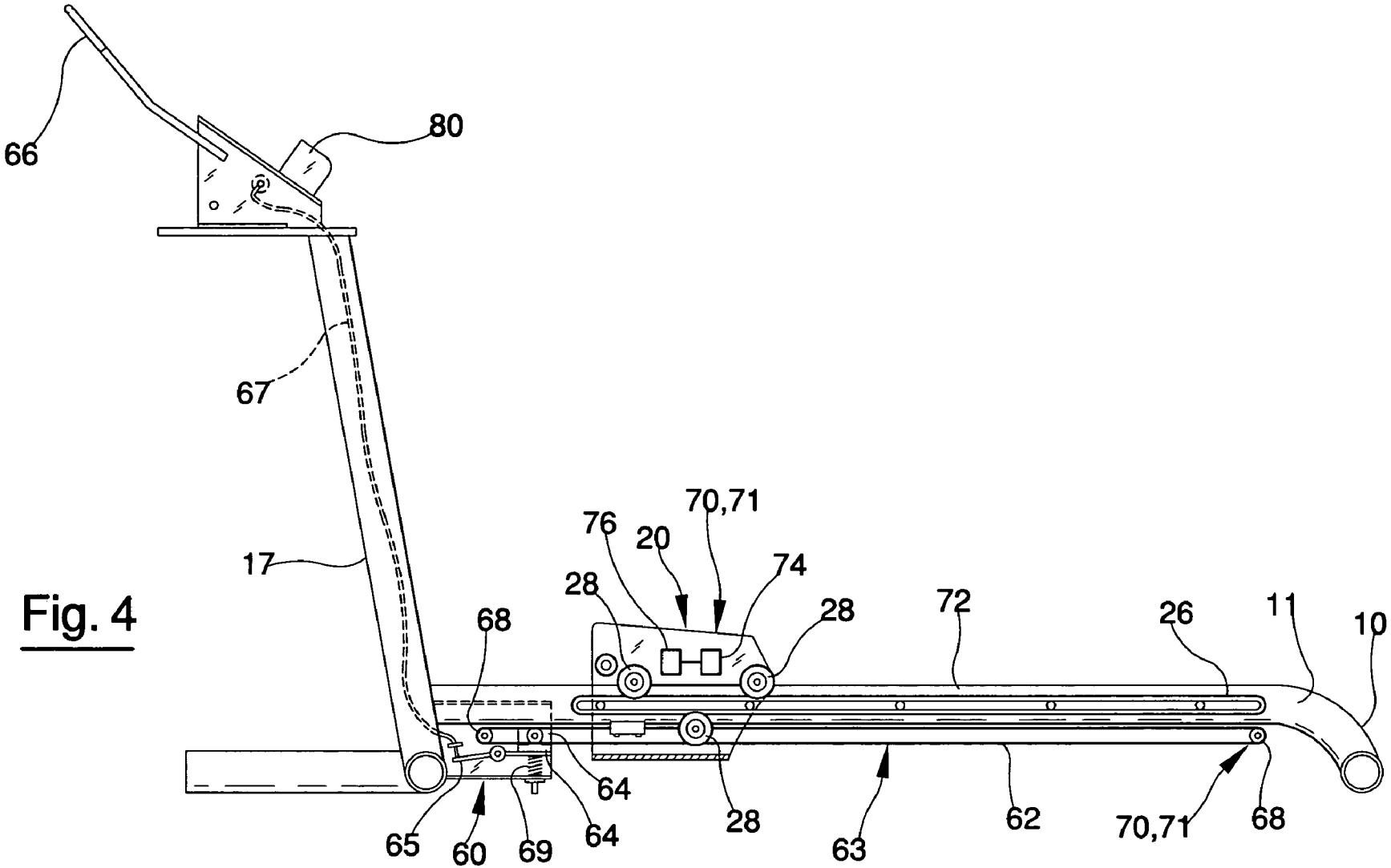
FIG. 4 a side elevation view of a second preferred embodiment of the machine in FIG. 1 with some parts removed for the sake of clarity.

Moreover, according to a further embodiment represented in FIG. 4, the measuring device 70 may be constructed using a device of the digital type. Said measuring device 70 comprises a transducer 71 provided with a rigid reference element 72 integrally connected to the frame 10, and particularly to the guide 21, and with a movable element 74 connected directly or indirectly to the slide 20. Furthermore, the measuring device 70 comprises a calculating device 76 for calculating the relative position between the movable element 74 and the rigid element 72 in order to generate data to indicate the instantaneous position of said slide 20 with respect to the starting station 30. Said transducer 71 could validly comprise an encoder that is indicated by the same reference number for the sake of convenience. In the case in point, the encoder 71 is of the linear type and the respective movable element 74 comprises a magnetic band associated with the foil 62 and indicated, again for convenience, by the same number 74.

The calculating device 76 can be carried on board the slide 20, and so can the movable element 74, but it could also be carried by the frame 10 in any other position, if arranged so as to exchange remote data with the movable element 74.

Alternatively, the encoder 71 could be of the rotating type and be associated with one of the transmission pulleys 68.

In view of the above description, the machine 1, described with reference to the accompanying drawings, punctually solves the technical problems set out above and its use is easy and safe even for users who are inexperienced in muscle stretching, so that it is useful in the prevention of muscle pains in the lumbar region.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A gymnastic machine, comprising:

a frame;

a longitudinal guide supported on the frame;

a starting station attached to the frame;

a slide displaceable along said longitudinal guide in a given direction from and to the starting station;

a support member associated with said slide for supporting a user's first limb to guide it along said given direction to enable a scissor movement of said first limb with respect to a user's second limb which is housed at the starting station; and regulating means for regulating the position of said support member with respect to said frame in order to control a stretching action exerted, in use, on said first limb during said scissor movement, wherein said regulating means comprises a first regulating device for varying the inclination of said support member with respect to said frame, in relation to the current distance between said slide and said starting station;

wherein said first regulating device comprises a roller tappet carried by said slide and a shaped member delimited by a profile suitable for controlling the rotation of said support member with respect to said frame.

2. A machine according to claim 1, wherein said profile is shaped like a plane decreasing towards said starting station.

3. A machine according to claim 1, wherein said regulating means comprises a second regulating device for adjusting the starting position of said support member with respect to said frame.

4. A machine according to claim 3, wherein said second regulating device comprises a support for said roller tappet that is adjustable in at least two positions in order to determine reference inclinations/starting inclinations of said support member with respect to said given direction.

5. A machine according to claim 1, wherein said starting station comprises housing means for stably housing said second limb, and that said frame comprises a rigid rest associated with said starting station.

6. A machine according to claim 5, wherein said housing means comprises a retaining member that can be selectively disengaged for holding a joint of said second limb.

7. A machine according to claim 6, wherein said retaining member is movably carried by said frame by means of an upright so that it can be selectively disengaged.

8. A machine according to claim 6, wherein said retaining member comprises at least a first cushion for the reference of said second limb.

9. A machine according to claim 1, wherein said support member presents an anterior portion shaped so as to provide support for a knee of said first limb and a posterior portion comprising a tibial cushion, suitable for supporting the neck of the foot of said first limb.

10. A machine according to claim 1, further comprising controlling means for controlling the position of said slide with respect to said starting station in order to prevent any straining of the musculature of the lower limbs.

11. A machine according to claim 10, wherein said regulating means for regulating the position of said slide comprises a braking device normally engaged and selectively switchable to be disengaged, and thereby enabling, in use, the alternate locking and release of the movement of said slide from and to said starting station.

12. A machine according to claim 11, wherein said braking device comprises an elongated member rigidly connected to said slide and carried parallel to said given direction between a pair of jaws, at least one of which is movable transversally to said given direction against the force of a spring in order to inactivate said braking device and enable the actuation of said slide.

13. A machine according to claim 12, wherein said braking device comprises a manually-operated member carried by said frame for controlling the movement of at least one of said jaws from and to a respective locking position wherein said elongated member is firmly held by said pair of jaws so as to prevent any movement of said slide along said given direction.

14. A machine according to claim 12, wherein said elongated member comprises a foil wound in a ring around two transmission elements carried by said frame, said foil being connected to said slide by means of respective ends and being provided with a braking branch that engages a space delimited by said jaws in order to be alternately locked in place or left free to move with respect to said jaws.

15. A machine according to claim 1, further comprising measuring means for measuring the position of said slide with respect to the said starting station.

16. A machine according to claim 15, wherein said measuring means comprises a transducer provided with a rigid reference element integrally connected to the frame, and with a movable element connected directly or indirectly to said slide, and with a calculating device for calculating the relative position between said movable element and said rigid reference element in order to generate data to indicate the instantaneous position of said slide with respect to said starting station.

17. A machine according to claim 16, wherein said movable element is enabled to remotely exchange data with said calculating device.

18. A machine according to claim 16, wherein said transducer comprises an encoder.

19. A machine according to claim 18, wherein said encoder is of the linear type and that said movable element is associated with said foil.

20. A machine according to claim 18, wherein at least one of said transmission elements comprises a pulley, wherein said encoder is of the rotating type and wherein said respective movable element is associated with said pulley.

21. A machine according to claim 15, wherein said measuring means comprises an analogical measuring device connected to said slide and calibrated so as to identify the current position of the slide itself with respect to said starting station.

22. A machine according to claim 21, wherein said measuring device comprises a metal tape measure provided with one end connected to said slide, which can be unwound against a spring return mechanism and which is at least partially protected by a casing for safety reasons.

23. A machine according to claim 22, wherein said casing is associated with said frame.

24. A machine according to claim 23, wherein said tape measure comprises a tape provided with a graduated scale wound in a spiral inside a box, said tape being provided with one end connected to said slide to enable the latter's current position to be measured with respect to said starting station; said tape being wound around a plurality of pulleys supported by said frame in order to define a given path so as to facilitate the user's reading of said graduated scale during the training session.

25. A machine according to claim 11, further comprising timer means for timing the duration of an exercise or of the time interval during which said slide is held locked with respect to said starting station by means of said braking device.

26. A machine according to claim 5, wherein said rigid rest comprises a second cushion for the upper part of the user's body.

27. A machine according to claims 5, wherein said rigid rest comprises a handle suitable for frontal gripping.

28. A machine according to claim 1, further comprising actuating means for actuating said slide with respect to said starting station.

29. A machine according to claim 28, wherein said actuating means comprises, in use, the action of gravity on said first limb.

30. A machine according to claim 1, wherein said slide is carried by a guide of the rectilinear motion provided with at least two elongated members; said slide being supported bilaterally by means of the interposition of a plurality of rollers.

31. A machine according to claim 1, wherein said first limb comprises a first lower limb and that said second limb comprises a second lower limb distinguished from said first lower limb.

* * * * *